US006550276B2

(12) United States Patent
Frank

(10) Patent No.: US 6,550,276 B2
(45) Date of Patent: Apr. 22, 2003

(54) REVERSIBLE AND INTERCHANGEABLE JEWELRY

(76) Inventor: Alan J. Frank, 82-28 211 St., Hollis Hills, NY (US) 11427

( * ) Notice: Subject to any disclaimer, the term of this patent is extended or adjusted under 35 U.S.C. 154(b) by 0 days.

(21) Appl. No.: 09/880,248

(22) Filed: Jun. 14, 2001

(65) Prior Publication Data

US 2002/0189285 A1 Dec. 19, 2002

(51) Int. Cl.[7] ..... A44C 17/02
(52) U.S. Cl. ..... 63/31; 63/29.1
(58) Field of Search ..... 63/31, 29.1

(56) References Cited

U.S. PATENT DOCUMENTS 915,678 A * 3/1909 Kantor et al. ..... 63/31
1,220,233 A * 3/1917 Jones ..... 40/1.6
1,553,198 A * 9/1925 Stern ..... 63/31
2,220,038 A * 10/1940 Kreisler et al. ..... 63/29.1
2,585,183 A * 2/1952 Stern ..... 63/15
3,959,989 A * 6/1976 Bhandia ..... 63/15.65
4,970,878 A * 11/1990 Lee ..... 63/23
5,950,456 A * 9/1999 Kirsch, Jr. ..... 63/31
6,032,486 A 3/2000 Uchin

* cited by examiner

*Primary Examiner*—J. J. Swann
*Assistant Examiner*—Andrea Chop
(74) *Attorney, Agent, or Firm*—Salzman & Levy

(57) ABSTRACT

An article of jewelry with ornamental male and female inserts that are reversible relative to their frame. The inserts form an opening on top to accept wire from a balled wire attached to the tubing on the frame. The balled wire allows the inserts to be flipped easily, while a wire, passing through the tubing, is the axis of rotation. A spring wire is attached to the bottom of the frame and fits into a notch formed by the mating inserts to secure the inserts in place. A stop is positioned on the back of the frame to prevent the inserts from extending beyond the back of the frame.

16 Claims, 3 Drawing Sheets

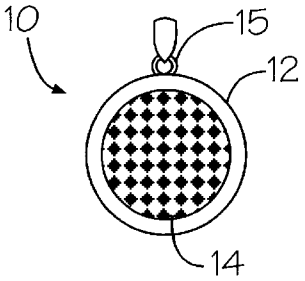
Figure 6a
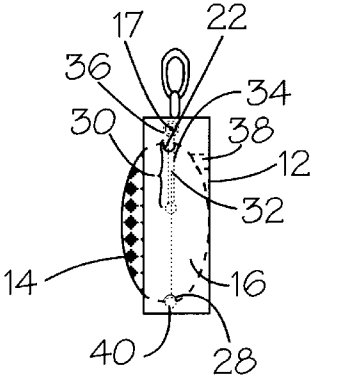
Figure 6b
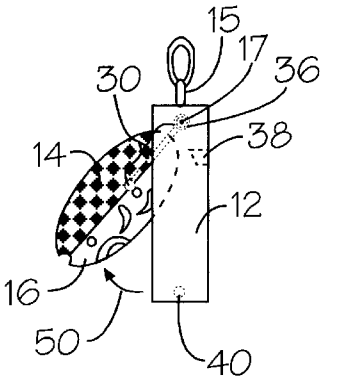
Figure 6c
Figure 6d
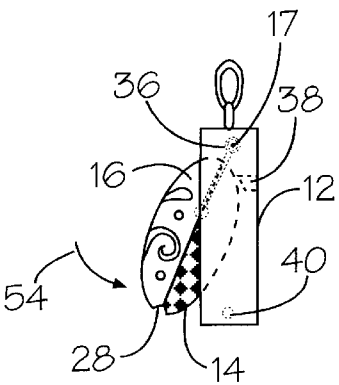
Figure 6e
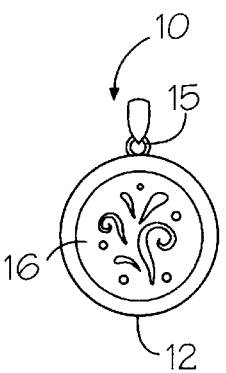
Figure 6f

REVERSIBLE AND INTERCHANGEABLE JEWELRY

FIELD OF THE INVENTION

The present invention relates to jewelry and, more particularly, to jewelry containing rotatable or reversible faces for exposing a different face.

BACKGROUND OF THE INVENTION

For centuries, one of the most common indications of sophistication and personal style is jewelry. Even ancient royalty in Egypt were known to wear jewelry and be entombed with it. Only the rich could afford to purchase jewelry and it was worn as a sign of wealth. Individual pieces of jewelry were often custom made to cater to the style of the rich. A large collection of jewelry was desirable, of course, since more jewelry implied more wealth. Historically, consumers wanting different jewelry designs or motifs were forced to purchase different types of jewelry. The jewelry's cost, design, style and colors are characteristics that have consumers choosing one piece of jewelry over another. Yet, high costs of jewelry often make it very difficult for consumers to purchase each design and motif of jewelry they desire.

Travelling with jewelry also poses another problem. People are forced to choose the pieces of jewelry they would like to take with them. It is common for people to have matching earrings, necklaces, rings, and bracelets, which are worn with a specific outfit. Oftentimes, the color scheme or style of the jewelry allows it to be worn with only one specific outfit. When travelers have a few different types of these outfits, they are forced either to take a great amount of jewelry with them, or not to be as fashionable as they would like to be. Travelling with all of one's jewelry is clearly not a feasible solution, unfortunately, due to the large quantities of different types of jewelry needed to coordinate with different outfits.

High prices of jewelry have created a market for jewelry with reversible faces. A significantly greater amount of jewelry styles can be purchased if the jewelry's frame remained the same while the aesthetic facing was reversible. This type of jewelry would also enable a traveler to travel with more styles of jewelry, while not packing many more items.

DISCUSSION OF RELEVANT ART

In U.S. Pat. No. 6,032,486, issued to Uchin on Mar. 7, 2000 for REVERSIBLE JEWELRY, a pierced-ear earring is illustrated comprising a toggle having inner and outer sides and an earpost attached to the inner side. A perforation passes through two other sides of the toggle, and an upper portion of a loop is positioned within the perforation. A pendant, having first and second faces comprising non-identical ornaments, is attached to a lower portion of the loop. The loop and pendant are rotatable as a unit through 180 degrees about the axis of the perforation and, together with the toggle and earpost, form a unitary structure that is rotatable through 180 degrees about the axis of the earpost.

SUMMARY OF THE INVENTION

In accordance with the present invention, there is provided a reversible item of jewelry. The jewelry consists of a frame portion that holds two different decorative faces at one time. The decorative faces have the ability to flip over within the frame to expose the opposite face. A tubing portion is located on the upper portion of the frame. A wire runs through the tubing and is attached to the frame at either end. A balled wire portion is encased between mating male and female insert pillows and attaches to the tubing portion, allowing the insert pillows to be flipped easily. The insert face, or pillow portion, is either a male or female half with a decorative surface. Each insert pillow has a semi-circular cutout on its top, allowing the wire from the balled wire to pass through when two insert pillows are mated. A stop is attached to the back of the frame to prevent the pillow from coming through the back of the frame. A spring wire portion is located at the base of the frame to lock the insert pillows into place so that they do not flip on their own accord. A half-notch cutout on the bottom of each insert pillow combines with the mating insert to form a notch that locks onto the spring wire portion to secure the inserts to the frame. A full-notch cutout on the bottom of each insert pillow can also be used to lock into the spring wire.

More than one reversible item of jewelry can be attached by conventional means to one another. This orientation creates a single item of jewelry with multiple reversible ornamental members. Other, non-reversible, ornamental members can also be attached by conventional means to the reversible item of jewelry.

It is an object of this invention to provide jewelry with ornamental members that can be reversed relative to their frame.

It is another object of this invention to provide reversible jewelry that contains two mating insert pillows.

It is another object of this invention to provide reversible jewelry that can be flipped easily to expose the opposite face.

It is another object of this invention to provide reversible jewelry that can be locked into place within its frame.

DESCRIPTION OF THE DRAWINGS

A complete understanding of the present invention may be obtained by reference to the accompanying drawings, when considered in conjunction with the subsequent detailed description, in which:

FIGS. 6*a* through 6*f* illustrate a series of views of an item of jewelry being reversed within its frame.

For purposes of clarity and brevity, like elements and components will bear the same designation and numbering throughout all figures.

DESCRIPTION OF THE PREFERRED EMBODIMENT

Generally speaking, the invention is an article of jewelry with ornamental male and female inserts that are reversible relative to their frame.

Figure 1:
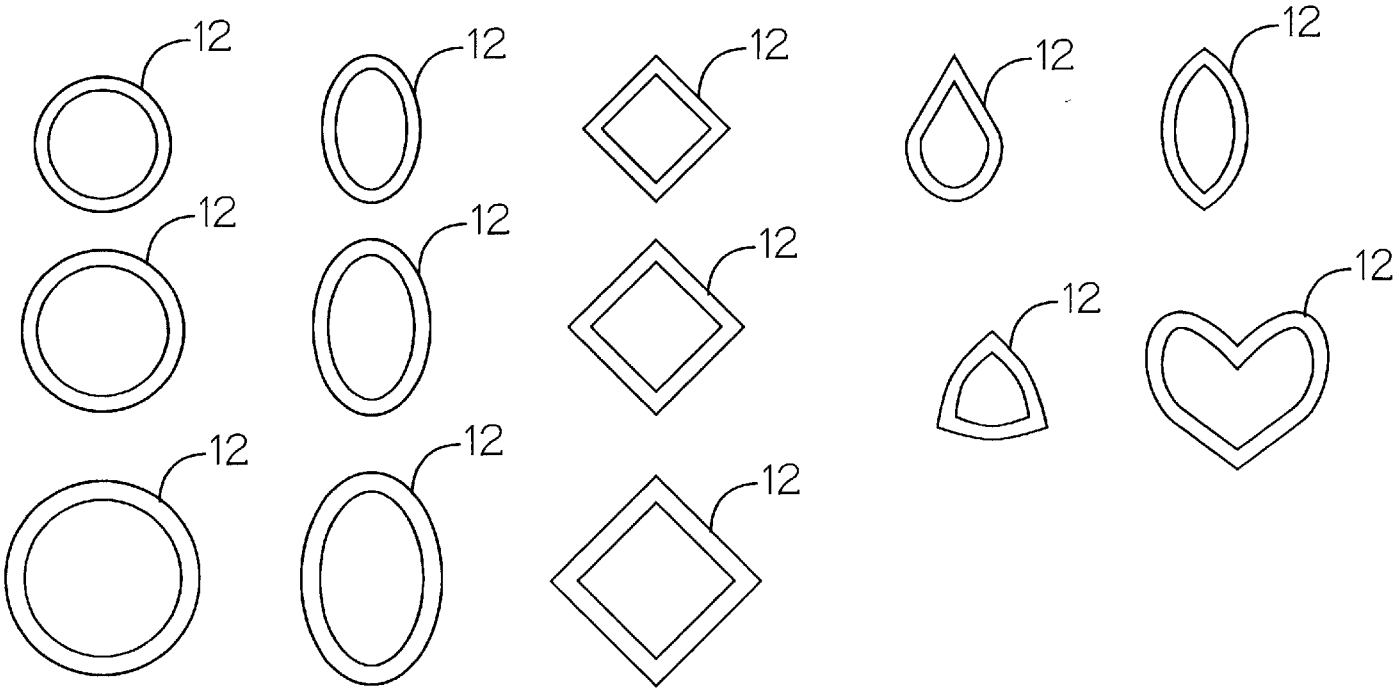
FIG. 1 illustrates a front view of different shapes and sizes of frame designs for jewelry in accordance with the present invention.

Referring now to FIG. 1, different shapes and sizes of jewelry frames 12 are illustrated. An item of jewelry 10 can be worn in different forms, including but not limited to earrings, pendants (FIGS. 6*a* through 6*f*), rings, and brooches. The shape and size of the frame 12 must be symmetrical about at least one axis. These shapes include a circle, oval, diamond, pear, triangle, marquis, and heart or any other suitable regular or irregular shape in various sizes. Any of these designs can be used as the shape of the frame 12 in any form of jewelry, as aforementioned. Preferably, the frame 12 is continuous, but it should be understood that frames that partially enclose an area could also be used. Moreover, more than one reversible item of jewelry (not shown) can be attached by conventional means to one another. This orientation creates a single item of jewelry with multiple reversible ornamental members. Other, non-reversible, ornamental members can also be attached by conventional means to the reversible item of jewelry.

Figure 2:
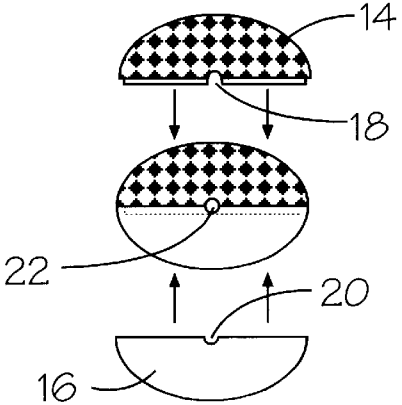
FIG. 2 illustrates a top view of male and female insert pillows, separately and mated.

Referring now to FIG. 2, insert pillows 14, 16 are illustrated. A male insert pillow 14, having a checkerboard pattern in this embodiment, and a corresponding female insert pillow 16 have respective semi-Docket circular holes, 18 and 20. The two pillows 14, 16 are at least partially hollow for mounting and rotating purposes, as described hereinbelow. When the two pillows 14, 16 are mated, the two semi-circular holes 18, 20 align to form a circular hole 22. While only two pillows 14, 16 are shown and described herein, a greater number of such pillows can be contemplated pursuant to certain design configurations.

Figure 3:
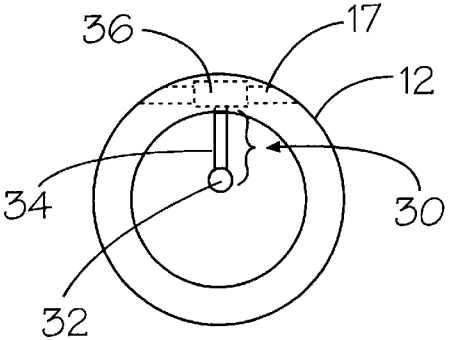
FIG. 3 illustrates a front view of a wire, tubing, and balled wire within the frame.

Referring now also to FIG. 3, wire 34 of a balled wire 30 is attached by conventional means both to ball 32 and to tubing 36. A securing wire 17 passes through tubing 36 and is secured to frame 12 at both distal ends. The wire 17 acts as the pin portion of a hinge and allows balled wire 30 to rotate on axis thereof. Balled wire 30 allows mating pillows 14, 16 to be easily flipped and rotated relative to the frame 12, as discussed below. The circular hole 22 allows for the passage of wire 34, which has a smaller diameter than does the ball 32 affixed thereto. After assembly, ball 32 is thus encapsulated between mated pillows 14, 16.

Figure 4:
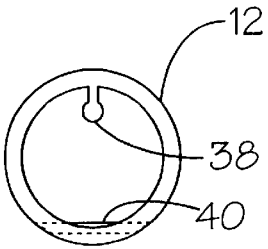
FIG. 4 illustrates a back view of the frame showing the stop and spring wire.

Referring now also to FIG. 4, a stop 38 is attached by conventional means to the back of interior portion of frame 12 to prevent the mated insert pillows 14, 16 from extending beyond the back of frame 12. Spring wire 40 is located on the bottom of frame 12 and is inserted therethrough. Spring wire 40 notches into the bottom of mating insert pillows 14, 16 and locks them into place so they will not flip over on their own accord.

Figure 5:
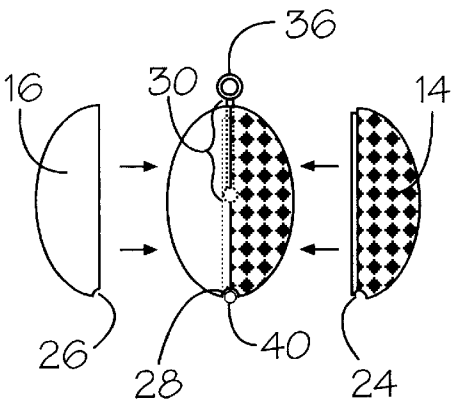
FIG. 5 illustrates a side view of male and female insert pillows, separately and mated.

Referring now also to FIG. 5, notches 24, 26 are formed in respective male insert pillow 14 and female insert pillow 16. The notches 24, 26 form a composite notch 28 on the bottom of pillows 14, 16, when assembled, that locks into spring wire 40.

Referring now also to FIGS. 6*a* through 6*f*, the process of flipping or reversing mating insert pillows 14, 16 to expose the opposite face is illustrated, in a series of configurations. FIGS. 6*a* through 6*f* illustrate respective discrete steps in a complete cycle of reversing the faces 14, 16 of jewelry 10. FIG. 6*a* shows a front view of the item of jewelry 10, shown as a pendant hanging from a chain link 15, with male insert pillow 14 exposed.

FIG. 6*b* shows a side view the jewelry 10. Frame 12 houses mating male insert pillow 14 and female insert pillow 16, which form a hole 22 on top and a notch 28 on bottom. Wire 34 of balled wire 30 is disposed through hole 22 with the ball 32 residing inside the mating insert pillows 14, 16. Balled wire 30 is connected to tubing 36 of frame 12. Wire 17 runs through tubing 36 and attaches to frame 12 on either end. Spring wire 40 is attached through frame 12 and locks into notch 28. Stop 38 is attached to the back of frame 12 and abuts the edge of the non-exposed insert pillow 16, preventing it from coming through the back of frame 12.

FIG. 6*c* shows the action of swinging (arrow 50) the mating insert pillows 14, 16 from frame 12, while wire 17, tubing 36, and balled wire 30 act as a hinge.

Once in fully deployed position, as shown in FIG. 6*d*, the mating insert pillows 14, 16 are rotated (arrow 52) in order to expose the female insert pillow 16.

FIG. 6*e* shows the mated insert pillows 14, 16 being returned into place (arrow 54). The notch 28 on the bottom of mating insert pillows 14, 16 is locked into spring wire 40, while stop 38 prevents mating insert pillows 14, 16 from extending past the back of frame 12.

FIG. 6*f* shows a front view of the item of jewelry 10 with the female insert pillow 16 exposed.

The mating insert pillows 14, 16 can be reversed as described hereinabove, either while being worn or when removed from the wearer's person, provided that the article of jewelry is meant to be freely suspended from a chain or bracelet.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of the invention.

Having thus described the invention, what is desired to be protected by Letters Patent is presented in the subsequently appended claims.

What is claimed is:

1. An article of jewelry with reversible and interchangeable pieces, comprising:

a relatively stationary jewelry frame having a plane and substantially enclosing an area;

two interchangeable mating, ornamental jewelry members for inserting into said area and being retained by said frame; and swivel means comprising a balled wire, said swivel means operatively connected to said frame and to said interchangeable mating, ornamental jewelry members for facilitating rotation thereof relative to said frame allowing for the removal of said jewelry members as a unit, substantially completely from said plane of said frame, thus providing interchangeability of said jewelry members.

2. The article of jewelry in accordance with claim 1, wherein said swivel means comprises a balled wire.

3. The article of jewelry in accordance with claim 2, wherein said interchangeable mating, ornamental jewelry members form an opening on their respective upper ends for facilitating attachment of said balled wire thereto.

4. The article of jewelry in accordance with claim 2, wherein said frame comprises a tubing portion connected thereto for securing said balled wire thereto.

5. The article of jewelry in accordance with claim 4, wherein said frame comprises a securing wire passing through said tubing portion for providing an axis of rotation for said balled wire.

6. The article of jewelry in accordance with claim 1, wherein said frame comprises a locking mechanism for securing said interchangeable mating, ornamental jewelry members to said frame.

7. The article of jewelry in accordance with claim 6, wherein said interchangeable mating, ornamental jewelry members form means for accepting said locking mechanism.

8. The article of jewelry in accordance with claim 1, wherein said frame further comprises a stopping mechanism attached thereto for confining said interchangeable mating, ornamental jewelry members in said frame.

9. An article of jewelry with interchangeable mating male and female, ornamental jewelry members, comprising:

a frame having a major plane for receiving said interchangeable mating, male and female ornamental jewelry members; and means comprising a balled wire, said means being operatively connected to said interchangeable mating, male and female ornamental jewelry members for facilitating rotation thereof relative to said frame allowing for the removal of said jewelry members as a unit, substantially completely from said major plane of said frame, thus providing interchangeability of said jewelry members.

10. The article of jewelry in accordance with claim 9, further comprising a ball and a wire connected to said ball, said ball and said wire being encapsulated by said interchangeable mating, male and female ornamental jewelry members for facilitating rotation thereof relative to said frame.

11. The article of jewelry in accordance with claim 10, wherein each of said interchangeable mating, male and female ornamental jewelry members has a semi-circular opening on its respective upper end and mates to form a circular opening.

12. The article of jewelry in accordance with claim 10, wherein said frame further comprises a tubing portion connected thereto for hingedly connecting said ball and said wire.

13. The article of jewelry in accordance with claim 12, wherein said frame further comprises a securing wire passing through said tubing portion for providing an axis of rotation for said ball and said wire.

14. The article of jewelry in accordance with claim 9, wherein said frame further comprises a locking mechanism for securing said interchangeable mating, male and female ornamental jewelry members to said frame.

15. The article of jewelry in accordance with claim 14, wherein each of said interchangeable mating, male and female ornamental jewelry members comprises a notch on its respective lower portion.

16. The article of jewelry in accordance with claim 9, wherein said frame further comprises a stop attached thereto for confining said interchangeable mating, male and female ornamental jewelry members in said frame.

* * * * *